United States Patent [19]

Chambers

[11] 4,245,701

[45] Jan. 20, 1981

[54] APPARATUS AND METHOD FOR IGNITING AN IN SITU OIL SHALE RETORT

[75] Inventor: Carlon C. Chambers, Grand Junction, Colo.

[73] Assignee: Occidental Oil Shale, Inc., Grand Junction, Colo.

[21] Appl. No.: 47,715

[22] Filed: Jun. 12, 1979

Related U.S. Application Data

[63] Continuation of Ser. No. 953,477, Oct. 23, 1978, abandoned.

[51] Int. Cl.[3] ..... E21B 43/24; F23D 15/02

[52] U.S. Cl. ..... 166/303; 166/59; 166/260

[58] Field of Search ..... 166/59, 303, 57, 302, 166/256, 259, 260; 299/2, 1; 431/183, 158

[56] References Cited

U.S. PATENT DOCUMENTS

| | | | |
|---|---|---|---|
| 2,188,737 | 1/1940 | Hixon | 166/59 |
| 2,668,592 | 2/1954 | Piros et al. | 166/59 X |
| 2,853,136 | 9/1958 | Moore et al. | 166/59 X |
| 2,890,755 | 6/1959 | Eurenius et al. | 166/59 |
| 3,204,696 | 9/1965 | DePriester et al. | 166/59 |
| 3,315,745 | 4/1967 | Rees, Jr. | 166/59 |
| 3,680,636 | 8/1972 | Berry et al. | 166/302 |
| 3,990,835 | 11/1976 | Burton | 431/353 |
| 4,136,737 | 1/1979 | Howard et al. | 166/251 |
| 4,137,968 | 2/1979 | Howard et al. | 166/53 |

*Primary Examiner*—Stephen J. Novosad
*Attorney, Agent, or Firm*—Christie, Parker & Hale

[57] ABSTRACT

A method and apparatus for conducting such method are disclosed for igniting a fragmented permeable mass of formation particles in an in situ oil shale retort. The method is conducted by forming a hole through unfragmented formation to the fragmented mass. An oxygen-containing gas is introduced into the hole. A fuel is introduced into a portion of the hole spaced apart from the fragmented mass. The fuel and oxygen-containing gas mix forming a combustible mixture which is ignited for establishing a combustion zone in a portion of the hole spaced apart from the fragmented mass. The hot gas generated in the combustion zone is conducted from the hole into the fragmented mass for heating a portion of the fragmented mass above an ignition temperature of oil shale.

15 Claims, 5 Drawing Figures

APPARATUS AND METHOD FOR IGNITING AN IN SITU OIL SHALE RETORT

CROSS REFERENCE TO RELATED APPLICATIONS

This is a continuation of application Ser. No. 953,477, filed Oct. 23, 1978, now abandoned.

BACKGROUND OF THE INVENTION

This invention relates to a method of igniting a subterranean fragmented permeable mass of formation particles containing oil shale within an in situ oil shale retort. The term "oil shale" as used in the industry is in fact a misnomer; it is neither shale, nor does it contain oil. It is a sedimentary formation comprising marlstone deposit with layers containing an organic polymer called "kerogen" which upon heating decomposes to produce hydrocarbon-containing liquid and gaseous products. The formation containing kerogen is called "oil shale" herein, and the hydrocarbon-containing liquid product is called "shale oil."

One technique for recovering shale oil includes forming an in situ oil shale retort in a subterranean formation containing oil shale. At least a portion of the formation within the boundaries of the in situ oil shale retort is fragmented to form a fragmented permeable mass of formation particles containing oil shale. Retort forming techniques are shown in U.S. Pat. Nos. 4,043,595; 4,043,596; 4,043,597; and 4,043,598, for example. Formation particles at the top of the fragmented mass are ignited to form a combustion zone, and an oxygen-containing gas, such as air, is supplied to the top of the fragmented mass for sustaining the combustion zone and advancing the combustion zone downwardly through the fragmented mass. As burning proceeds, the heat of combustion is transferred to the fragmented mass of particles below the combustion zone to decompose kerogen in the fragmented particles, producing shale oil and gaseous products therefrom in a retorting and vaporization zone. Thus, a retorting zone moves from top to bottom of the fragmented mass in advance of the combustion zone. The shale oil and gaseous products in the retorting zone pass to the bottom of the fragmented mass for collection.

When the fragmented permeable mass of formation particles is formed in the subterranean in situ oil shale retort, the fragmented particles can fill substantially the entire volume so that there is no significant void space above the fragmented mass. Oxygen-containing gas for combustion can be furnished to the fragmented mass by means of holes bored through overlying intact rock. Appreciable difficulty may be encountered, however, in igniting the top of the fragmented mass to support combustion. Ignition requires a substantial amount of heat delivered over a sufficient time to raise the temperature of fragmented particles of oil shale above an ignition temperature of shale oil. Considerable difficulty is encountered in providing burners for such ignition and assuring that ignition has been obtained. In a large retort several burners may be needed at the same time for igniting the top of the fragmented mass at several locations. It is therefore desirable to provide an inexpensive and reliable burner for igniting an in situ oil shale retort from a remote location. It is also desirable to provide a burner suitable for using shale oil for igniting a retort since this is the least expensive fuel available at the retort site.

SUMMARY OF THE INVENTION

According to the present invention there is provided a method and apparatus for conducting such method, for igniting a fragmented permeable mass of formation particles in an in situ oil shale retort in a subterranean formation containing oil shale.

The method for igniting a fragmented mass is conducted by forming a hole through unfragmented formation to the fragmented mass. An oxygen-containing gas is introduced into the hole. A fuel is introduced into a portion of the hole spaced apart from the fragmented mass. The fuel mixes with the oxygen-containing gas forming a combustible mixture. The combustible mixture is ignited establishing a combustion zone in a portion of the hole spaced apart from the fragmented mass. The combustion of the combustible material heats at least a portion of the wall of the hole adjacent the combustion zone. The hot gas generated in the combustion zone is conducted out of the hole and into the fragmented mass. The heat from the hot gas heats a portion of the fragmented mass above an ignition temperature of oil shale.

A swirling motion is imparted to the oxygen-containing gas as it is introduced into the hole, as it flows through the hole or by a combination of both events. By swirling the oxygen-containing gas, sufficient mixing of the oxygen-containing gas and fuel can be produced for providing a readily combustible mixture.

The apparatus for conducting the method for igniting a fragmented mass in an in situ oil shale retort can be lowered into or positioned within a hole which extends through unfragmented formation to the fragmented mass.

The apparatus comprises a support pipe and a liquid fuel supply pipe. Connected to the support pipe is means for imparting vortical flow to gas flowing along the length of the pipe. On the end of the fuel supply pipe is a liquid fuel nozzle. Means for centering the nozzle in a hole is connected to the pipe adjacent the nozzle. The means for centering has about the same diameter as the means for imparting vortical flow.

In the apparatus, the means for imparting vortical flow comprises a vortex plate connected to the support pipe. The plate has passages therethrough and a plurality of vanes extending generally radially and skewed relative to the axis of the support pipe.

The means for centering the nozzle comprises a plurality of spring legs extending generally radially from the support pipe and connected thereto. The legs extend from the support pipe and along its length for elastically engaging the wall of a bore hole into which the apparatus is placed.

BRIEF DESCRIPTION OF THE DRAWINGS

These and other features and advantages of the present invention will be appreciated as the same becomes better understood by reference to the following detailed description of a presently preferred embodiment when considered in connection with the accompanying drawings wherein.

DETAILED DESCRIPTION OF THE DRAWINGS

Figure 1:
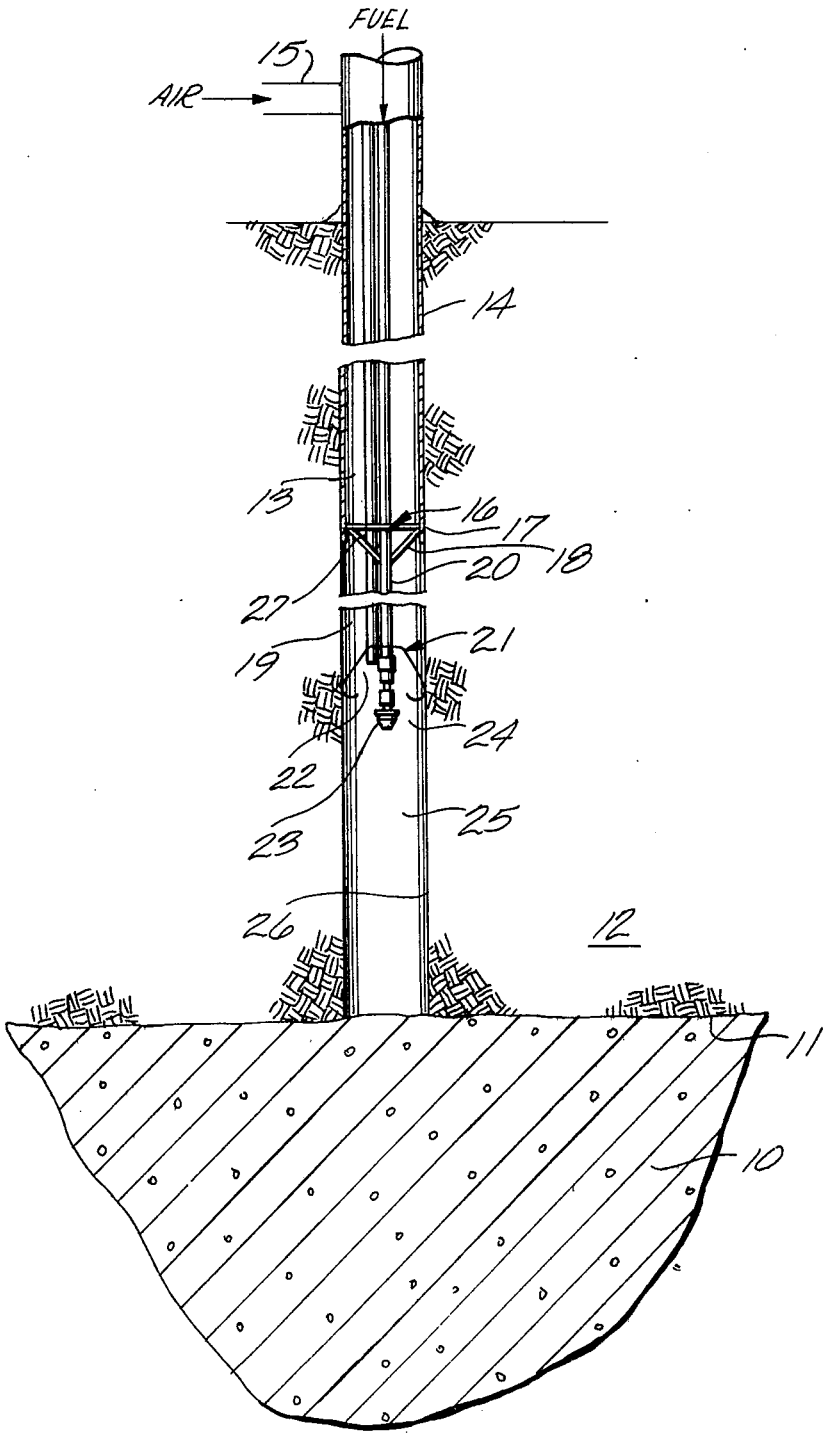
FIG. 1 illustrates in longitudinal cross section apparatus constructed according to principles of this invention in place adjacent the top of an in situ oil shale retort.

FIG. 1 illustrates in longitudinal cross section and partly schematically a burner arrangement for igniting a permeable, subterranean, combustible material. The apparatus of this invention can be used to ignite any such subterranean combustible material so long as the walls of the hole in which the apparatus is placed are satisfactory. In a preferred working embodiment such an apparatus was utilized to ignite a fragmented permeable mass of formation particles containing oil shale within an in situ oil shale retort. For convenience of description herein, the apparatus of this invention will be described in terms of igniting such a fragmented permeable mass of formation particles containing oil shale.

Only the very uppermost portion of the retort volume 10 is indicated in FIG. 1. This retort volume is indicated schematically by the combination of diagonal lines and circles. However, it will be understood that the volume contains a fragmented permeable mass of formation particles containing oil shale. Above the upper boundary 11 of the fragmented mass there is an overburden of unfragmented formation 12. The thickness of this unfragmented formation can range from a few tens of feet in some retorting arrangements to hundreds of feet in others.

A cylindrical hole 23 is formed through the unfragmented formation 12 to the upper boundary of the fragmented mass. This hole may be formed either before or after the formation of the fragmented mass. If the fragmented mass is formed using a bore hole through the unfragmented formation such an existing bore hole can be used for the burner of this invention. Such a hole can be made by conventional drilling techniques and reamed out to the desired size. A diameter of about 10 to 12 inches can be satisfactory, for example. In a working embodiment about a ten-inch drill hole was utilized.

In some or all of the unfragmented formation 12 is permeable, the hole 13 may be cased with steel pipe 14 or the like, down to an elevation within the hole such that a segment of the hole is left uncased between the end of the steel pipe and upper boundary 11 of the retort. Such a casing will inhibit the flow of fluid through the side of the hole.

An inlet conduit 15 for introducing an oxygen-containing gas into the hole 13 is provided. The flow of an oxygen-containing gas is downward through the hole from such an inlet conduit 15. The inlet conduit is positioned in relation to pipe 14 for introducing the oxygen-containing gas tangentially to the pipe and in a counterclockwise flow to cause the gas to flow downwardly through the pipe and hole 13. The oxygen-containing gas can be air, oxygen, air augmented with oxygen or diluted with inert gases or the like. The gas can be forced downwardly through the hole by a blower (not shown) connected to an inlet conduit 15. Alternatively, the top of the hole can be left open and air drawn in by reason of withdrawal of gas from the bottom of the retort.

Figure 2:
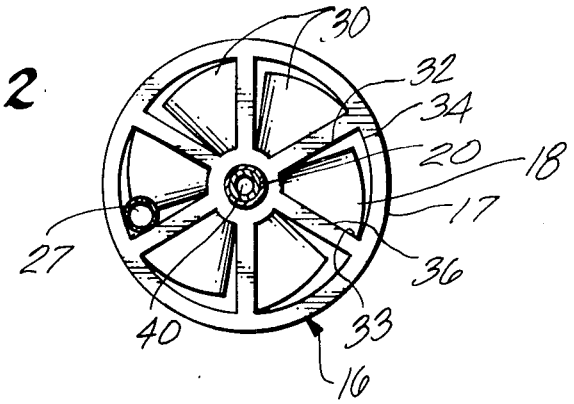
FIG. 2 illustrates in transverse cross section means for imparting a vortical flow to the oxygen-containing gas for the apparatus.
Figure 3:
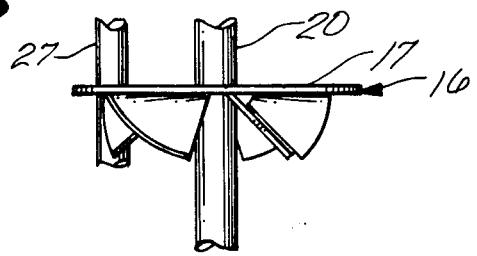
FIG. 3 is a side view of the means illustrated in FIG. 2 for imparting a vortical flow to the oxygen-containing gas.

The downward flowing oxygen-containing gas encounters means 16 within the hole 13 for imparting a vortical motion to the oxygen-containing gas. With reference to FIGS. 2 and 3 the means for imparting vortical flow comprises a vortex plate 17 slightly smaller than the inside diameter of the hole 13 and the casing 14. The plate 17 is welded onto the outside of a support pipe 20 and has openings 30 to allow the oxygen-containing gas to flow therethrough. Such openings 30 freely allow the flow of the oxygen-containing gas through the plate. The openings can be provided by forming cutouts in a solid circular plate. For example, with reference to FIG. 2, a solid metal circular plate can be cut along lines 32, 33 and 34. The resultant piece of metal partially bounded by such lines is then bent along line 36 to provide an opening 30 on the surface of the plate. The resultant piece of metal can be removed to increase air flow therethrough. Positioned below and attached to plate 17 are a plurality of baffles or vanes 18 skewed relative to a vertical axis through the hole and at about a 45 degree angle to the plate for imparting vortical motion or swirling to the oxygen-containing gas passing down the hole into a first portion 19 of the hole below the vortex plate. Such baffles can be formed by the same process as described above for forming the openings in the plate. For example, a piece of metal bent along line 36 can form the baffle 18 for imparting a vortical motion to any gas flowing through the openings in the plate.

The vortex plate is supported from the support pipe 20. Within the support pipe 20 is a fuel supply pipe 40. The support pipe 20 and vortex plate 17 keep the fuel pipe centered in the hole and support the lower end of an igniter line 27.

Figure 4:
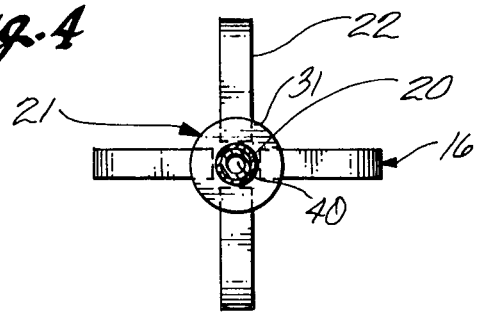
FIG. 4 illustrates in transverse cross section means for centering the nozzle in a hole.
Figure 5:
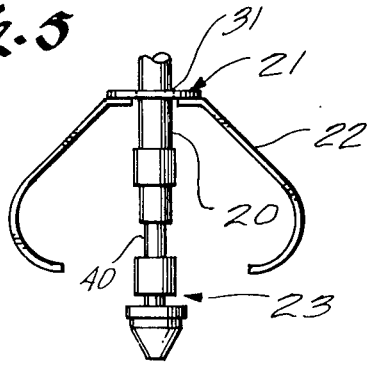
FIG. 5 is a side view or longitudinal cross section of the means illustrated in FIG. 4 and means for introducing fuel.

Positioned within the hole 13 below the vortex generating baffles 18 is means 21 for introducing a fuel into a second portion 24 of the hole downstream of the first portion 19 of the hole. For example, the means 21 can be positioned about seven feet below the vortex plate 17. With reference to FIGS. 4 and 5, the means for introducing a fuel comprises a stabilizer in the form of a multi-legged "spider" which fits into the hole. The spider has a circular plate 31 welded to the outside of the support pipe 20 and four steel legs 22 welded to the plate. The steel legs of the spider are somewhat flexible and springy. The legs 22 extend generally radially from the support pipe and also along the length of the pipe. Thus the legs are angled so as to fit readily into a hole with rough walls and elastically engage the wall of the hole to maintain the lower end of the support pipe 20, stabilized and centered within the hole. With the legs extended and engaging the wall of the hole, the stabilizer has a diameter about the same as the diameter of the vortex plate. A nozzle 23 is attached to the end of the fuel supply pipe 40 below the legs 22. The nozzle is positioned from about two to five feet above the lower end of the hole and sprays the liquid fuel downward into the third portion 25 of the hole wherein the liquid fuel mixes with the swirling oxygen-containing gas. The fuel nozzle 23 can be any convenient nozzle capable of spraying a liquid fuel in such a manner that the liquid fuel is atomized by the nozzle, or is thoroughly mixed with the oxygen-containing gas through the swirling action of the oxygen-containing gas flowing down the hole.

Suitable nozzles for introducing liquid fuel include nozzles which provide a spray of the liquid fuel in a continuous stream or in a conical spray pattern. Suitable nozzles can also be nozzles which provide for premixing of liquid fuel and oxygen-containing gas. Such nozzles are commercially available. For example, acceptable nozzles for use with shale oil as the liquid fuel include Unijet nozzle #0002, Fulljet nozzle #1507, Premix nozzle #1891125, Spraco nozzle #11-0620-0523, Unijet nozzle #0003 and Fulljet nozzle #⅛ G1502.5. All of these nozzles are commercially available products of Spraying Systems Co. of St. Louis, Mo. Atomization of the liquid fuel delivered through the nozzle can be accomplished by the nozzle, such as when a spray nozzle is used, or can be accomplished or enhanced by the swirling action of the oxygen-containing gas flowing down the hole. Such a nozzle centered in the hole prevents the liquid fuel from being introduced into the hole as a stream or along the side of the hole to avoid inadequate mixing of the liquid fuel and oxygen-containing gas. The nozzle 23 is adapted to spray the liquid fuel in a substantially downward direction for mixing with the swirling oxygen-containing gas. The swirling mixture of atomized fuel and oxygen-containing gas continues to flow downward within the hole.

The fuel introduction means 21 is positioned within the second portion 24 of the hole above the lower end of the hole such that a third portion 25 of the hole lies between the nozzle 23 and the top of the fragmented mass 10. Such a third portion of the hole provides a combustion chamber for the fuel and oxygen-containing gas mixture. The third portion 25 of the hole below the fuel nozzle 23 can be from about two to about five feet in length, for example. Such a length of from about two to about five feet provides a sufficient combustion zone for igniting the fuel and oxygen-containing gas mixture and also provides a sufficient distance between the top of the fragmented mass and the fuel nozzle for preventing thermal degradation of the fuel nozzle after the fragmented mass has been ignited. Distances of less than two feet subjects the components of the apparatus to greater exposure to the heat generated by the combustion of the fragmented mass following its ignition. Distances greater than five feet require longer burning times to supply the necessary heat to the top of the fragmented mass for ignition. The mixture is ignited in any convenient manner such as by dropping a lighted standard railroad flare down an igniter line 27 or, if no igniter line is used, by lowering a flare down the hole 13. The lighted flare falls past the centering spider into the combustion chamber in the third portion 25 of the hole igniting the downwardly flowing fuel and oxygen-containing gas mixture. An electric igniter can be used and an easily ignited fuel used to initiate combustion if desired.

A flame sensing means for determining ignition of the mixture of fuel and oxygen-containing gas can be provided through the igniter line 27. Any convenient type of flame sensing device can be used such as a sight glass at the top of the igniter line or an ultraviolet light flame sensor electrical circuit.

A presently preferred working embodiment of apparatus which is useful as a burner in the practice of the method of this invention is illustrated in FIG. 1. The burner comprises a vertically extending hole 13 extending to a fragmented permeable mass of formation particles 10 containing oil shale. The hole is cylindrical with a diameter of about ten inches. A cylindrical steel casing 14 having an inside diameter of about 9¼ inches is fitted into an upper portion of the hole.

The means 16 for imparting vortical flow to inlet oxygen-containing gas has a circular plate 17 somewhat less than 9¼ inches in diameter. Six baffles 18 are formed by providing the openings 30 for gas flow on the circular plate. Such openings and baffles are formed by cutting the circular plate along lines 32, 33 and 34 and then bending the metal cutout, downwardly along line 36. The baffles formed are skewed relative to the vertical axis through the center of the hole 13 and to the plate 17 at about 45° so as to impart a swirling motion to the oxygen-containing gas passing downward and through the plate.

The plate also stabilizes a 1¼ inch in diameter igniter pipe 27 and a 1½ inch in diameter support pipe 20 within which is a ⅜ inch O.D. stainless steel fuel supply pipe 40 extending through the center of the plate. Both the igniter pipe 27 and the support and fuel supply pipes extend upwardly through the hole for connection of the fuel pipe to a source of liquid fuel (now shown). The fuel supply pipe can be flexible above the vortex plate, but it is preferred that the fuel supply pipe be a solid steel pipe below the plate.

In the working embodiment air, as the oxygen containing gas, is introduced tangentially into the hole and flows down the hole striking the baffles 18, whereby the air continues to swirl as it flows down the hole. A liquid fuel consisting of shale oil is sprayed from the nozzle 23 in a downward direction. The nozzle acts as an atomizer for the liquid shale oil, atomizing the shale oil into the swirling air intimately mixing the shale oil and air. The mixture continues downwardly into the third portion 25 of the hole. A standard railroad flare is ignited and dropped into the hole through the igniter pipe 27. The lighted flare drops out of the end of the igniter pipe and ignites the swirling mixture of shale oil and air in the third portion of the hole thereby establishing a combustion zone within such third portion. A strong flame is directed downward in the hole 13 so that hot gas is conducted out of the lower end of the hole to impinge on the top portion of the fragmented permeable mass of formation particles containing oil shale within the retort. The flame in the lower portion of the hole spaced apart from the fragmented mass heats the wall of the hole to help maintain a stable flame. The wall of the hole thereby provides a combustion chamber.

This burning of shale oil is conducted until a substantial volume of oil shale has been heated above its ignition temperature such that a combustion zone is established within the fragmented mass and the combustion within the fragmented mass is self-sustaining.

A combustion chamber can be needed to maintain a stable flame in a burner for igniting an in situ oil shale retort. The burner described herein avoids special combustion chamber problems by employing the wall 26 of the bore hole as the combustion chamber. Complicated structures and difficulties with heat resistant materials can be avoided. Such an arrangement of a burner for igniting an in situ oil shale retort is satisfactory since oil shale has low thermal conductivity and sufficiently resists thermal damage to maintain a high wall temperature in the third portion 25 of the hole where burning occurs and thereby stabilizes the flame. The effective length of the combustion chamber is also easily adjusted, merely by raising or lowering the fuel supply pipe to which the nozzle is connected. The flowing air around the nozzle and other elements of the burner cools them and helps keep the flame in the proper portion of the hole.

Although but a single embodiment of this invention has been described and illustrated herein, many modifications and variations will be apparent to one skilled in the art. Thus, for example, the relative proportions of the elements of the burner can be modified appreciably to provide for combustion of fuel having a lower or higher fuel value than the shale oil for which the burner was designed. Similarly, it will be apparent that if a substantial area of fragmented mass is involved it may be preferable to have a plurality of holes containing burners over the top of the fragmented mass so that ignition is obtained at several points and that the distance for lateral propagation of the flame front in the fragmented mass is minimized. Many other modifications and variations will be apparent to one skilled in the art and it is therefore understood that within the scope of the appended claims, the invention may be practiced otherwise than as specifically described.

What is claimed is:

1. A method for igniting a fragmented permeable mass of formation particles in an in situ oil shale retort in a subterranean formation containing oil shale comprising the steps of:

forming a hole through unfragmented formation, the lower end of the hole being above the fragmented mass;

introducing an oxygen-containing gas into the hole;

introducing a fuel into a portion of the hole spaced apart from the fragmented mass for forming a combustible mixture with the oxygen-containing gas;

igniting the combustible mixture for establishing a combustion zone in a portion of the hole above the fragmented mass, whereby at least a portion of the wall of the hole adjacent the combustion zone is heated; and conducting hot gas from the combustion zone in the hole from the lower end of the hole into the fragmented mass for heating a portion of the fragmented mass above an ignition temperature of oil shale.

2. A method as recited in claim 1 wherein the fuel comprises a liquid fuel.

3. A method as recited in claim 1 wherein the fuel comprises shale oil.

4. A method as recited in claim 1 wherein the oxygen-containing gas is swirled in the hole for mixing with the fuel.

5. A method as recited in claim 4 wherein the oxygen-containing gas is swirled by introducing oxygen-containing gas tangentially to the hole imparting a counter-clockwise vortical flow to the oxygen-containing gas.

6. A method as recited in claim 1 wherein the fuel comprises liquid shale oil sprayed into a portion of the hole from an axially centered nozzle.

7. A method as recited in claim 1 wherein oxygen-containing gas is introduced by withdrawing gas from the fragmented mass, thereby drawing oxygen-containing gas into the hole.

8. An apparatus for igniting an in situ oil shale retort comprising:

fuel supply pipe means;

means connected to the outside of the pipe means a substantial distance from the end of the pipe means for imparting vortical flow to gas flowing along the length of the pipe means;

a nozzle on the end of the pipe means for spraying a liquid fuel; and means connected to the pipe means adjacent the nozzle for axially centering the nozzle in a bore hole, the means for centering being about the same width as the means for imparting vortical flow.

9. An apparatus as recited in claim 8 wherein the means for imparting vortical flow comprises a vortex plate connected to the pipe means having flow passages therethrough and a plurality of vanes extending generally radially and skewed relative to the axis of the pipe means.

10. An apparatus as recited in claim 8 wherein the means for centering comprises a plurality of spring legs extending generally radially from the pipe means and also along the length of the pipe means for elastically engaging the walls of a bore hole.

11. An apparatus as recited in claim 8 further comprising means extending along the pipe means and in proximity to the nozzle for providing ignition to the fuel.

12. An apparatus as recited in claim 11 wherein the means for providing ignition comprises an igniter pipe.

13. An apparatus as recited in claim 8 wherein the pipe means comprises a support pipe encircling a fuel supply pipe.

14. A method for igniting a fragmented permeable mass of formation particles in an in situ oil shale retort in a subterranean formation containing oil shale comprising the steps of:

forming a hole through unfragmented formation to the fragmented mass;

introducing an oxygen-containing gas into the hole;

spraying liquid shale oil from an axially centered nozzle into a portion of the hole spaced apart from the fragmented mass for forming a combustible mixture with the oxygen-containing gas;

igniting the combustible mixture for establishing a combustion zone in a portion of the hole spaced apart from the fragmented mass, whereby at least a portion of the wall of the hole adjacent the combustion zone is heated; and conducting hot gas from the combustion zone in the hole into the fragmented mass for heating a portion of the fragmented mass above an ignition temperature of oil shale.

15. A method for igniting a fragmented permeable mass of formation particles in an in situ oil shale retort in a subterranean formation containing oil shale comprising the steps of:

forming a hole through unfragmented formation to the fragmented mass;

withdrawing gas from the fragmented mass for drawing an oxygen-containing gas into the hole;

introducing a fuel into a portion of the hole spaced apart from the fragmented mass for forming a combustible mixture with the oxygen-containing gas;

igniting the combustible mixture for establishing a combustion zone in a portion of the hole spaced apart from the fragmented mass, whereby at least a portion of the wall of the hole adjacent the combustion zone is heated; and conducting hot gas from the combustion zone in the hole into the fragmented mass for heating a portion of the fragmented mass above an ignition temperature of oil shale.

* * * * *

UNITED STATES PATENT AND TRADEMARK OFFICE

CERTIFICATE OF CORRECTION

PATENT NO. : 4,245,701

DATED : January 20, 1981

INVENTOR(S) : Carlon C. Chambers

It is certified that error appears in the above—identified patent and that said Letters Patent is hereby corrected as shown below:

Column 1, preceding "Background of the Invention" insert -- The Government of the United States of America has rights in this invention pursuant to Cooperative Agreement DE-FC20-78LC10036 awarded by the U. S. Department of Energy.--

Signed and Sealed this

*Nineteenth* Day of *January 1982*

[SEAL]

*Attest:*

GERALD J. MOSSINGHOFF

*Attesting Officer*

*Commissioner of Patents and Trademarks*